US009814102B2

(12) United States Patent
Franca et al.

(10) Patent No.: US 9,814,102 B2
(45) Date of Patent: Nov. 7, 2017

(54) ROTARY SWITCH WITH IMPROVED SIMMER PERFORMANCE

(75) Inventors: Leopoldo H. Franca, Joinville (BR); Foad M. Kesheh, Joinville (BR); Moacyr C. Possan, Jr., Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 611 days.

(21) Appl. No.: 13/614,180

(22) Filed: Sep. 13, 2012

(65) Prior Publication Data

US 2013/0001214 A1 Jan. 3, 2013

Related U.S. Application Data

(62) Division of application No. 12/643,001, filed on Dec. 21, 2009, now Pat. No. 8,344,292.

(51) Int. Cl.

| | |
|---|---|
| ***H01R 13/713*** | (2006.01) |
| ***H01R 33/72*** | (2006.01) |
| ***H05B 3/68*** | (2006.01) |
| ***H05B 1/02*** | (2006.01) |

(52) U.S. Cl.
CPC ..... *H05B 3/68* (2013.01); *H05B 1/0266* (2013.01)

(58) Field of Classification Search
CPC ..... F24C 14/02; F24C 15/022; F24C 7/087
USPC ..... 219/412–414, 443–448, 483, 486; 99/329 R, 329 P, 331, 378, 393
See application file for complete search history.

(56) References Cited

U.S. PATENT DOCUMENTS

| | | | | |
|---|---|---|---|---|
| 7,038,176 | B2 * | 5/2006 | Sterling | 219/483 |
| 2009/0134143 | A1 * | 5/2009 | Shukla et al. | 219/443.1 |

* cited by examiner

*Primary Examiner* — Tu B Hoang
*Assistant Examiner* — Thomas Ward
(74) *Attorney, Agent, or Firm* — Price Heneveld LLP

(57) ABSTRACT

A cooking appliance has a cooktop including a plurality of separately controlled cooking areas. A first heating element and a second heating element are positioned below one of the separately controlled cooking areas. A control switch is electrically coupled to the first heating element and the second heating element and is operable to selectively energize the first heating element with single-phase AC power and selectively energize the second heating element with two-phase AC power.

7 Claims, 4 Drawing Sheets

ROTARY SWITCH WITH IMPROVED SIMMER PERFORMANCE

CROSS-REFERENCE TO RELATED APPLICATIONS

The present application represents a divisional application of U.S. patent application Ser. No. 12/643,001 entitled "Rotary Switch with Improved Simmer Performance," now U.S. Pat. No. 8,344,292, issued on Jan. 1, 2013.

TECHNICAL FIELD

The present disclosure relates generally to cooking appliances. The present disclosure relates more particularly to control switches for operating the heating elements of cooking appliances.

BACKGROUND

A cooking appliance is used to cook meals and other foodstuffs on a cooktop or within an oven. The cooking appliance typically includes various control switches and electronics to control the heating elements of the cooking appliance.

SUMMARY

According to one aspect, a cooking appliance includes a cooktop having a plurality of separately controlled cooking areas, a first heating element positioned below one of the separately controlled cooking areas, and a second heating element positioned below the same separately controlled cooking area as the first heating element, and a control switch electrically coupled to the first heating element and the second heating element. The control switch is operable to selectively energize the first heating element with single-phase AC power and selectively energize the second heating element with two-phase AC power.

In some embodiments, the first and second heating elements may be arranged as a non-concentric heating device positioned below the separately controlled cooking area. The control switch may be positionable in at least (i) a first temperature adjustment zone in which only the first heating element is energized and (ii) a second temperature adjustment zone in which both the first heating element and the second heating element are simultaneously energized. The control switch may also be positionable in a home position in which both the first heating element and the second heating element are de-energized. In some embodiments, the control switch may be an infinite switch.

In other embodiments, the first heating element may be electrically coupled between a neutral electrical line and a first terminal of the control switch operable to supply AC power at a first phase. The second heating element may be electrically coupled between the first terminal of the control switch and a second terminal of the control switch operable to supply AC power at a second phase, different than the first phase.

In still other embodiments, the cooking appliance may also include a thermal limiter electrically coupled to at least one of the first and second heating elements, the thermal limiter operable to de-energize at least one of the first and second heating elements when a temperature of the separately controlled cooking area above the first and second heating elements exceeds a specified temperature. In such embodiments, the cooktop may be a glass-ceramic cooktop.

According to another aspect, a cooking appliance includes a first heating element positioned below a cooktop, a second heating element positioned below the cooktop in proximity to the first heating element, and a control switch electrically coupled to the first heating element and the second heating element. The control switch may be positionable in at least a first position and a second position, wherein the control switch, (i) when in the first position, energizes only the first heating element at a first voltage and, (ii) when in the second position, simultaneously energizes both the first heating element at the first voltage and the second heating element at a second voltage, the second voltage being of a greater magnitude than the first voltage.

In some embodiments, the first and second heating elements may be arranged as a non-concentric heating device positioned below the cooktop. In other embodiments, the cooking appliance may also include a first electrical line supplying AC power at a first phase, a second electrical line supplying AC power at a second phase, different than the first phase, and a neutral electrical line. In such embodiments, the control switch may be operable to electrically couple the first electrical line and the neutral electrical line across the first heating element and electrically couple the first electrical line and the second electrical line across the second heating element.

In still other embodiments, the first voltage may be approximately 120 volts AC and the second voltage may be approximately 240 volts AC. The control switch may be an infinite switch. The first position of the control switch may lie within a first temperature adjustment zone having a substantially infinite number of settings, and the second position of the control switch may lie within a second temperature adjustment zone having a substantially infinite number of settings.

According to yet another aspect, a method of operating a cooking appliance includes energizing only a first heating element with single-phase AC power to supply heat to a separately controlled cooking area and energizing, simultaneously, both the first heating element with single-phase AC power and a second heating element with two-phase AC power to supply heat to the separately controlled cooking area.

In some embodiments, energizing only the first heating element may include positioning a control switch within a first temperature adjustment zone having a substantially infinite number of settings. Simultaneously energizing both the first heating element and the second heating element may include positioning the control switch within a second temperature adjustment zone having a substantially infinite number of settings. The method may also include de-energizing both the first heating element and the second heating element by positioning the control switch at a home position. In other embodiments, the method may also include measuring a temperature of the separately controlled cooking area and de-energizing at least one of the first heating element and the second heating element when the temperature of the separately controlled cooking area exceeds a specified temperature.

BRIEF DESCRIPTION OF THE DRAWINGS

The detailed description particularly refers to the following figures, in which.

DETAILED DESCRIPTION OF THE DRAWINGS

Figure 1:
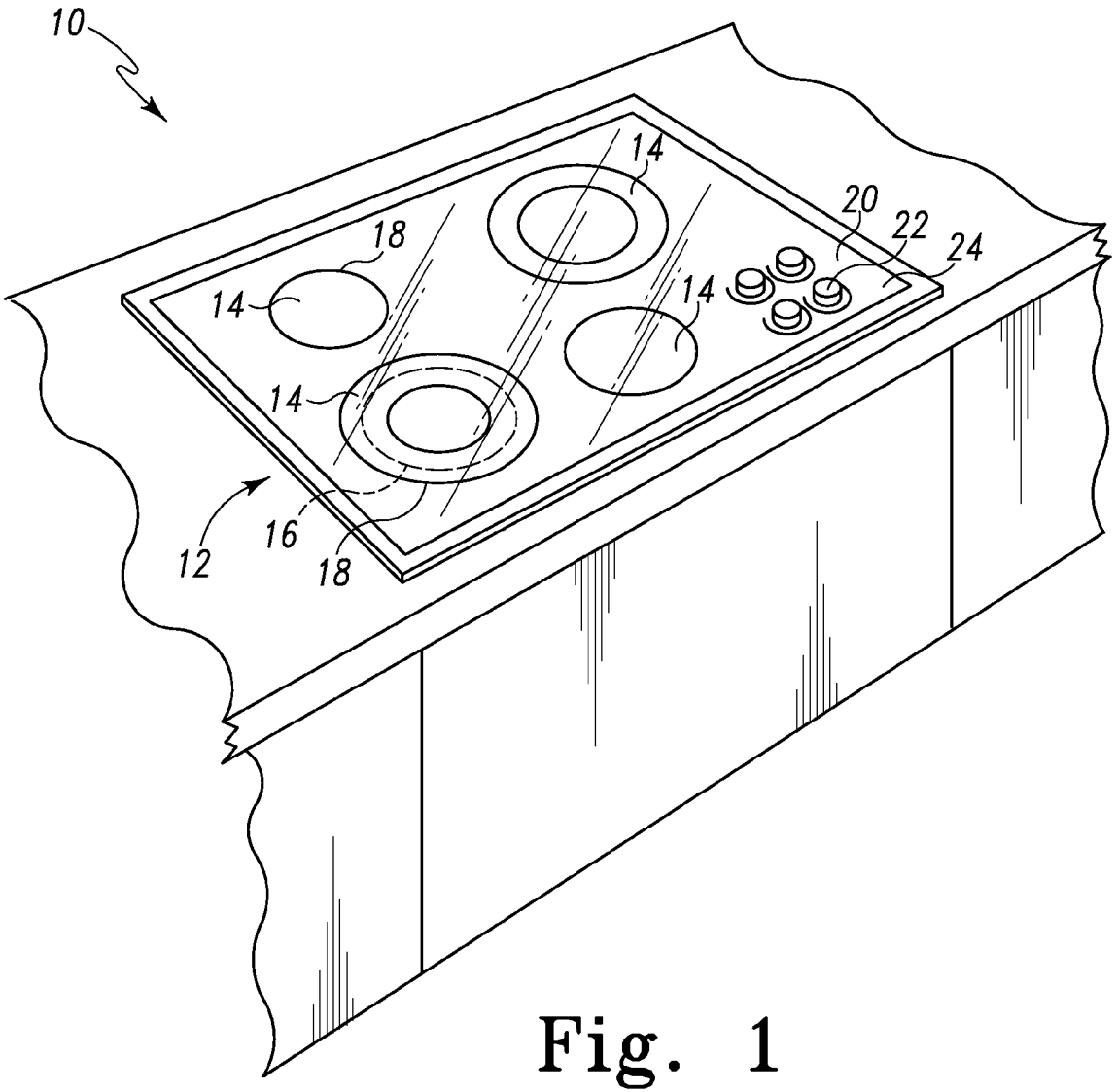
FIG. 1 is a perspective view of a cooking appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a cooking appliance 10 is shown. The cooking appliance 10 includes a cooktop 12. As shown in FIG. 1, the cooktop 12 is a glass-ceramic cooktop. The cooktop 12 has a plurality of separately controlled cooking areas 14. It should be appreciated that the term "separately controlled cooking area" as used herein refers to a location or zone of the cooktop that may be operated by the user independently from the remainder of the cooktop. Each separately controlled cooking area may have a burner or other heating device dedicated to supplying heat to that area of the cooktop. The heat supplied to each separately controlled heating area is controlled such that a command to change the heat supplied to it does not change the amount of heat supplied to any other separately controlled cooking area. In the illustrative embodiment of FIG. 1, the cooktop 12 has four separately controlled cooking areas 14.

A heating device 16 is positioned below each separately controlled cooking area 14. Each heating device 16 is operable to heat only the corresponding separately controlled cooking area 14 to desired cooking temperatures. An outer perimeter 18 designates to a user where the user should place pots, pans, and the like to be heated by each separately controlled cooking area 14.

The cooking appliance 10 also includes a control panel 20 positioned adjacent to the cooktop 12. A user may separately control the temperature of each of the plurality of separately controlled cooking areas 14 using a set of knobs 22 positioned on a top surface 24 of the control panel 20. As the user rotates one of the knobs 22, a control switch 30 (see FIGS. 2 and 3) coupled to the knob 22 adjusts the heat generated by the corresponding heating device 16 to change the temperature of one of the plurality of separately controlled cooking areas 14.

Figure 2:
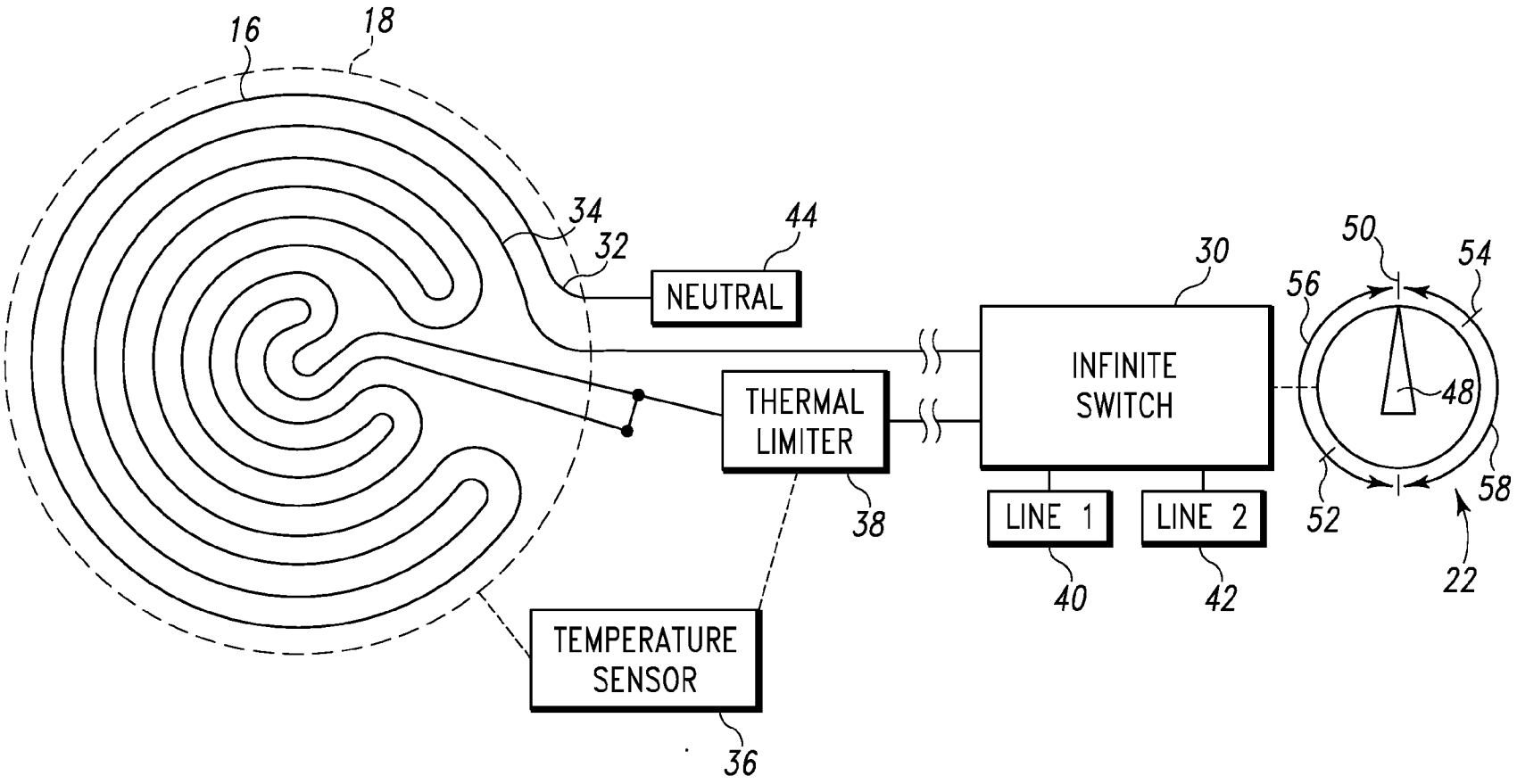
FIG. 2 is a top plan view of a separately controlled cooking area, and associated controls, of the cooking appliance of FIG. 1.
Figure 3:
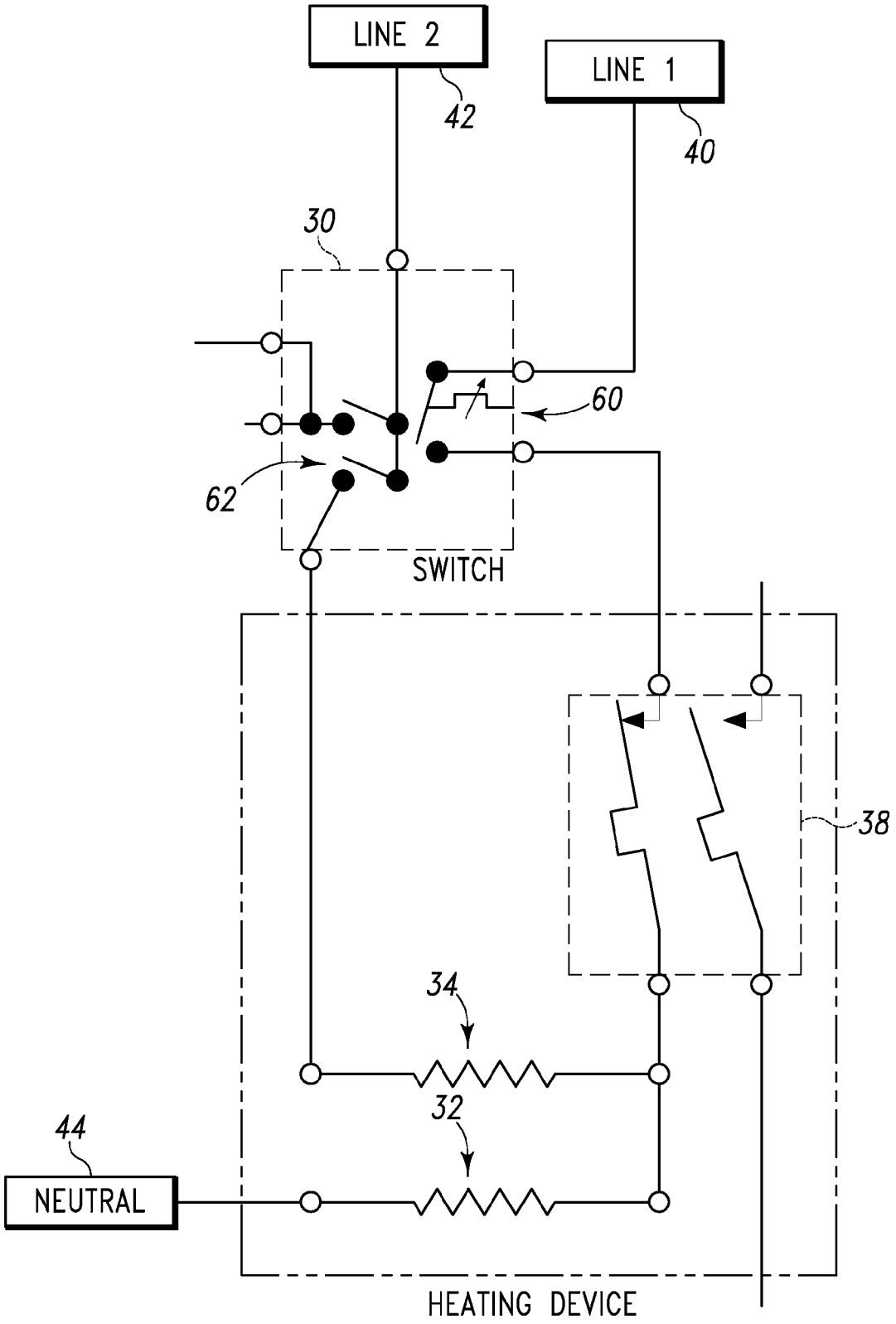
FIG. 3 is a circuit diagram of the separately controlled cooking area and associated controls of FIG. 2.

Referring now to FIGS. 2 and 3, one of the separately controlled cooking areas 14 and its associated controls are shown in greater detail. A heating device 16 is positioned below the separately controlled cooking area 14. The heating device 16 includes a resistive heating element 32 and a resistive heating element 34 that both generally fit within the outer perimeter 18. The heating elements 32, 34 each generate heat when energized with electrical power. In some embodiments (such as that shown in FIG. 2), the heating elements 32, 34 may be arranged in a non-concentric manner. In such a non-concentric heating device 16, the heating elements 32, 34 will each apply heat to substantially the entire separately controlled cooking area 14 when energized. In other embodiments (not shown), the heating elements may be arranged in substantially concentric circles. In such a concentric heating device, the heating elements will only apply heat to a specific portion (e.g., an inner or outer portion) of the corresponding separately controlled cooking area when energized.

In operation, the heating elements 32, 34 of heating device 16 supply heat to the separately controlled cooking area 14, which raises the temperature of that cooking area 14. A temperature sensor 36 is operable to measure the temperature of the separately controlled cooking area 14. The measured temperature is relayed to a thermal limiter 38 coupled to the heating elements 32, 34. In some embodiments, the temperature sensor 36 and the thermal limiter 38 may be components of the heating device 16 that is installed below the separately controlled cooking area 14. When the measured temperature exceeds a specified temperature, the thermal limiter 38 is operable to deenergize the heating elements 32, 34 by severing their connection to the control switch 30 and, thus, to the power supply. In this way, the thermal limiter 38 prevents the heating device 16 from subjecting the separately controlled cooking area 14 to temperatures that would damage the glass-ceramic cooktop 12. When the temperature measured by the temperature sensor 36 drops below the specified temperature, the thermal limiter 38 reconnects the heating elements 32, 34 to the power supply, allowing the heating elements 32, 34 to once more generate heat, which is supplied to the separately controlled cooking area 14.

The heating element 34 is configured as a main, or primary, element of the heating device 16, while the heating element 32 is configured as a simmer element of the heating device 16. The heating element 34 is electrically connected, via the control switch 30 and the thermal limiter 38, between an electrical line 40 ("Line 1") supplying AC power at one phase and an electrical line 42 ("Line 2") supplying AC power at a second, different phase. In contrast, the heating element 32 is electrically connected, via the control switch 30 and the thermal limiter 38, between the electrical line 40 ("Line 1") and a neutral electrical line 44 ("Neutral"). It will be understood that the voltage between Line 1 and Line 2 (two-phase AC power) will be of greater magnitude than the voltage between either Line 1 or Line 2 and Neutral (single-phase AC power), due to the phase difference between the two electrical lines 40, 42. Standard voltage ratings are 240 volts between Line 1 and Line 2 and 120 volts between either Line 1 or Line 2 and Neutral. The configuration of the heating elements 32, 34 with respect to the control switch 30 and the electrical lines 40-44 is best seen in FIG. 3 and will be discussed in more detail below.

The control switch 30 includes several terminals which allow electrical coupling with the heating elements 32, 34. The control switch 30 is operable to selectively energize the heating elements 32, 34 and vary the amount of power supplied to each element. Varying the power supplied to each of the heating elements 32, 34 changes the quantity of heat generated by each of the heating elements 32, 34 and, consequently, changes the temperature of the separately controlled cooking area 14. As shown in FIGS. 2 and 3, the control switch 30 is embodied as an infinite switch 30 having a primary, cyclical switch 60 and a secondary switch 62. The infinite switch 30 is so-called because its knob 22 may be positioned at a substantially infinite number of settings between 0 and 360 degrees. It will be appreciated that in other embodiments the control switch 30 may be any type of analog switch, digital controller, or other like device operable to vary the power supplied to the heating elements 32, 34.

The control switch 30 is coupled to the knob 22 via a rotating shaft (not shown). The knob 22 includes a pointer 48 or other indicia that indicates the angular position of both the knob 22 and the control switch 30. Depending on the angular position of the control switch 30, power may be supplied to only the heating element 32 or to both heating elements 32, 34 together. As shown in FIG. 2, the knob 22 and control switch 30 are shown in a home, or starting, position 50. When the control switch 30 is located at the home position 50, no power is supplied to either heating element 32, 34 and both the heating element 32 and the heating element 34 are de-energized. As the knob 22 is rotated away from the home position 50, the control switch 30 selectively supplies power to the heating elements 32, 34. The knob 22 may be rotated in a clockwise (CW) manner, counter-clockwise (CCW) manner, or both, depending on the desired configuration.

In addition to the home position 50, several other angular positions of the knob 22 and the control switch 30 are indicated in FIG. 2. A first position 52 may be located anywhere within a first temperature adjustment zone 56. A second position 54 may be located anywhere within a second temperature adjustment zone 58. In some embodiments (such as that shown in FIG. 2), the first and second temperature adjustment zones 56, 58 may each be approximately 180 degrees, or half of the full rotation of knob 22. It will be appreciated that in other embodiments the first and second temperature adjustment zones 56, 58 may be of differing sizes and the knob 22 may also have additional temperature adjustment zones. Furthermore, the temperature adjustment zones and home position of knob 22 may located at any suitable angular position.

When the knob 22 is located at the first position 52 (i.e., in the first temperature adjustment zone 56), the control switch 30 permits power to be supplied only to the heating element 32. The control switch 30 opens the secondary switch 62 when the knob 22 enters the first temperature adjustment zone 56, severing the electrical connection between the heating element 34 and the electrical line 42. Because the heating element 34 does not receive power, the heating element 34 is de-energized. When the knob 22 is located at the second position 54 (i.e., in the second temperature adjustment zone 58), the control switch 30 permits power to be supplied to both the heating element 32 and the heating element 34, such that both heating elements 32, 34 are energized. The control switch 30 closes the secondary switch 62 when the knob 22 enters the second temperature adjustment zone 58, electrically coupling the heating element 34 with the electrical line 42.

In addition to selectively energizing the heating elements 32, 34, the control switch 30 varies the amount of power supplied to each of the heating elements 32, 34, in accordance with the position of the knob 22. As shown in FIG. 3, the control switch 30 includes a primary switch 60 which operates in a cyclical manner. Where the control switch 30 is embodied as an infinite switch, the primary switch 60 may be a bimetallic element that repeatedly changes shape with changes in temperature. As the primary switch 60 cyclically opens and closes, the control switch 30 will either apply the supply voltage to the heating device 16 and energize the heating elements 32, 34 or will isolate the heating device 16 from the supply voltage and consequently de-energize the heating elements 32, 34. A desired temperature output is achieved, not by altering the voltage applied to the heating device 16, but instead by cycling "on" and "off" times. Through the cyclic ratio (i.e., the respective length of the "on" and "off" times), an average power is supplied to the energized heating elements 32, 34. Thus, upon increasing rotation of the knob 22 (in a CW or CCW direction, or both, depending on the desired configuration), the primary switch 60 will actuate for progressively longer time intervals, ranging from zero percent in the home position 50 to a maximum percent of the total actuation time in the maximum heat position(s).

Figure 4:
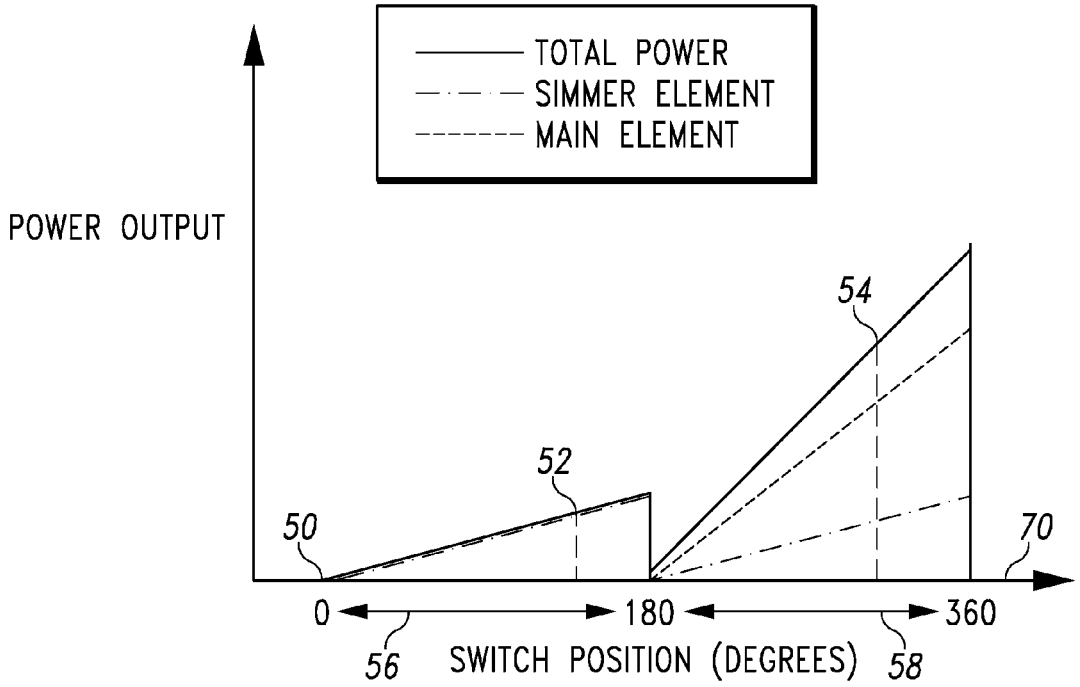
FIG. 4 is a graph of the average power supplied to the separately controlled cooking area of FIG. 2 as a function of control switch position, according to one embodiment.
Figure 5:
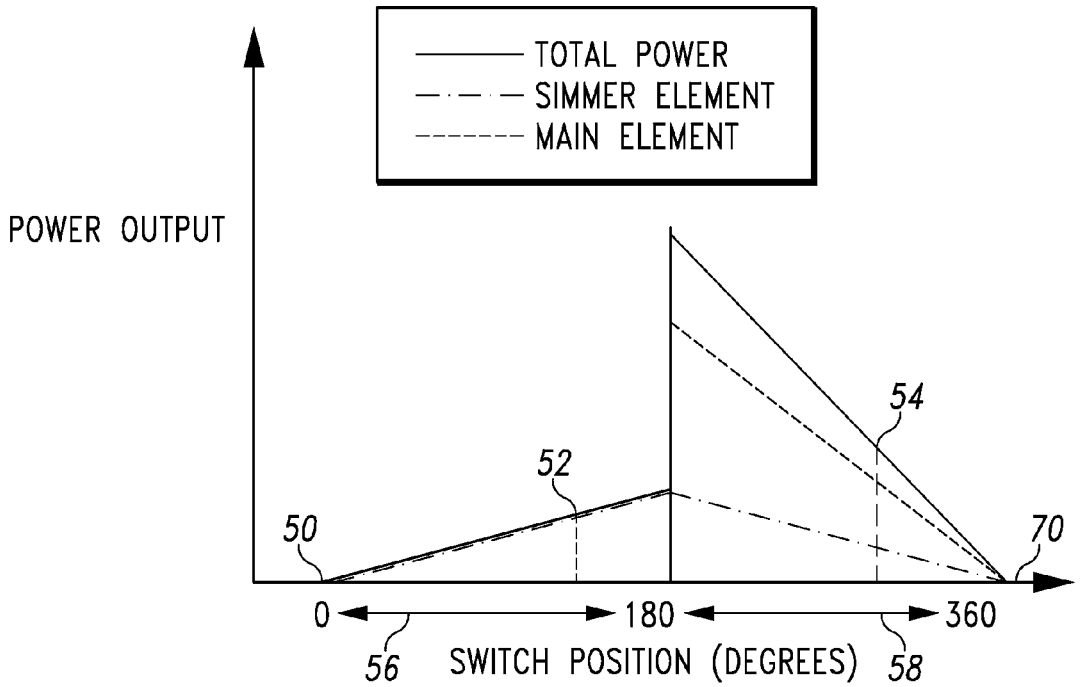
FIG. 5 is a graph of the average power supplied to the separately controlled cooking area of FIG. 2 as a function of control switch position, according to another embodiment.

The average power supplied to the heating elements 32, 34 is shown graphically in FIGS. 4 and 5 as a function of the angular position of the knob 22 for two exemplary control switches 30. The home position 50, the first position 52, and the second position 54 (as illustrated in FIG. 2) are demarcated along a first axis 70 in FIGS. 4 and 5. The first temperature adjustment zone 56 and the second temperature adjustment zone 58 are also demarcated along the first axis 70.

According to the embodiment shown in FIG. 4, the average power supplied to the heating elements 32, 34 increases as the knob 22 and the control switch 30 rotate in the CCW direction from the home position 50. Because the heating elements 32, 34 generate heat in proportion to the amount of power supplied, the heat generated by the heating elements 32, 34 also increases as the knob 22 and the control switch 30 rotate in a CCW direction from the home position 50. When the knob 22 is located at the home position 50, the control switch 30 supplies no power to either of the heating elements 32, 34 and both heating elements 32, 34 are de-energized.

When the knob 22 is located at the first position 52 (i.e., in the first temperature adjustment zone 56), the control switch 30 energizes the heating element 32 with single-phase AC power, and the heating element 32 supplies an amount of heat to the separately controlled cooking area 14 suitable for simmering operation. As the knob 22 is rotated CCW from the home position 50 through the first temperature adjustment zone 56, the control switch 30 increases the power supplied to the heating element 32 such that the heating element 32 supplies additional heat to the separately controlled cooking area 14. That influx of additional heat raises the temperature of that cooking area 14. As will be appreciated from FIG. 4, the total power output of the heating device 16 in the first temperature adjustment zone 56 is equal to the power output of the heating element 32 ("Simmer Element").

When the knob 22 is located at the second position 54 (i.e., in the second temperature adjustment zone 58), the control switch 30 simultaneously energizes the heating element 32 with single-phase AC power and the heating element 34 with two-phase AC power. The heating elements 32, 34 together supply an amount of heat to the separately controlled cooking area 14 suitable for cooking operation. As the knob 22 is rotated CCW through the second temperature adjustment zone 58, the control switch 30 increases the power supplied to the heating elements 32, 34 such that the heating elements 32, 34 supply additional heat to the separately controlled cooking area 14. That influx of additional heat raises the temperature of that cooking area 14. As will be appreciated from FIG. 4, the total power output of the heating device 16 in the second temperature adjustment zone 58 is equal to the combined power output of the heating element 34 ("Main Element") and the heating element 32 ("Simmer Element").

Another embodiment using a different exemplary control switch 30, but otherwise similar to the system of FIG. 4, is illustrated in FIG. 5. According to this embodiment, the average power supplied to the heating elements 32, 34 increases as the knob 22 and the control switch 30 rotate in both the CW and CCW directions from the home position 50 (toward 180 degrees). As in the previous embodiment, when the knob 22 is located at the home position 50, the control switch 30 supplies no power to either of the heating elements 32, 34 and both heating elements 32, 34 are de-energized. The behavior of the system in the first temperature adjustment zone 56 is also substantially similar to that described with reference to FIG. 4.

When the knob 22 is located at the second position 54 (i.e., in the second temperature adjustment zone 58), the control switch 30 simultaneously energizes the heating element 32 with single-phase AC power and the heating element 34 with two-phase AC power. As the knob 22 is rotated CW through the second temperature adjustment zone 58, the control switch 30 increases the power supplied to the heating elements 32, 34 such that the heating elements 32, 34 supply additional heat to the separately controlled cooking area 14. Thus, in the embodiment represented in FIG. 5, a user may alternatively turn the knob 22 in the CCW direction from the home position 50 for simmering operation and in the CW direction from the home position 50 for cooking operation.

It should be understood that the operations of the two exemplary control switches 30 represented in FIGS. 4 and 5 are but a few of the many possible modes of operation. Furthermore, both FIGS. 4 and 5 illustrate the output of heating devices 16 having heating elements 32, 34 with similar resistance values (thus, the power output of the heating element 34 is approximately four times the power output of the heating element 32). It will be appreciated that many different types of heating elements having varying properties may be used to provide any number of output characteristics for the heating device 16.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A method of operating a cooking appliance, comprising:

providing a cooktop having a plurality of separately controlled cooking areas;

positioning at least a first heating element and a second heating element below at least one of the plurality of separately controlled cooking areas;

coupling an infinite control switch electrically to the first and second heating elements, wherein the infinite control switch is operable to selectively energize simultaneously the first heating element with single-phase AC power and the second heating element with two-phase AC power;

selectively energizing only the first heating element with single-phase AC power to supply heat to the separately controlled cooking area; and selectively energizing, simultaneously, both the first heating element with single-phase AC power and a second heating element with two-phase AC power to supply heat to the separately controlled cooking area.

2. The method of claim 1, wherein energizing only the first heating element comprises positioning the infinite control switch within a first temperature adjustment zone having an infinite number of settings.

3. The method of claim 2, wherein energizing, simultaneously, both the first heating element and the second heating element comprises positioning the infinite control switch within a second temperature adjustment zone having an infinite number of settings.

4. The method of claim 3, further comprising de-energizing both the first heating element and the second heating element by positioning the infinite control switch at a home position.

5. The method of claim 1, further comprising:

measuring a temperature of the separately controlled cooking area; and de-energizing at least one of the first heating element and the second heating element when the temperature of the separately controlled cooking area exceeds a specified temperature.

6. The method of claim 1, further comprising: positioning the infinite control switch to electrically couple a first electrical line and a neutral electrical line across the first heating element and electrically couple to the first electrical line and a second electrical line across the second heating element.

7. The method of claim 1, further comprising: positioning the infinite control switch in at least one of (i) a first temperature adjustment zone position in which only the first heating element is energized, (ii) a second temperature adjustment zone position in which both the first and second heating elements are simultaneously energized, and (iii) a home position in which both the first heating element and the second heating element are de-energized.

* * * * *